US005724933A

United States Patent [19]

Silvonen et al.

[11] Patent Number: 5,724,933

[45] Date of Patent: Mar. 10, 1998

[54] PISTON UNIT FOR AN INTERNAL COMBUSTION ENGINE

[75] Inventors: Aulis Silvonen, Vaasa; Trygve Ahlroth, Vasa; Pasi Halla-aho, Laihia, all of Finland

[73] Assignee: Wartsila Diesel International Ltd Oy, Helsinki, Finland

[21] Appl. No.: 610,597

[22] Filed: Mar. 6, 1996

[30] Foreign Application Priority Data

Mar. 9, 1995 [FI] Finland ..... 951105

[51] Int. Cl.[6] ..... F02F 3/00

[52] U.S. Cl. ..... 123/193.6

[58] Field of Search ..... 123/193.6; 92/216, 92/220, 222, 174, 255, 258

[56] References Cited

U.S. PATENT DOCUMENTS

| | | | |
|---|---|---|---|
| 2,159,402 | 5/1939 | Retschy | 92/220 |
| 2,194,097 | 3/1940 | Reggio | 123/193.6 |
| 3,323,503 | 6/1967 | Grosshans et al. . | |
| 4,083,292 | 4/1978 | Goloff . | |
| 4,372,194 | 2/1983 | Vallaude | 123/193.6 |
| 4,375,782 | 3/1983 | Schieber | 123/193.6 |
| 4,517,930 | 5/1985 | Nakano et al. | 123/193.6 |
| 4,587,932 | 5/1986 | Moebus | 123/193.6 |

FOREIGN PATENT DOCUMENTS

| | | |
|---|---|---|
| 0 185 352 | 6/1986 | European Pat. Off. . |
| 1 337 311 | 5/1963 | France . |
| 2 246 742 | 5/1975 | France . |
| 2 396 172 | 1/1979 | France . |
| 25 46 388 | 4/1977 | Germany . |
| 26 48 392 | 4/1978 | Germany . |
| 31 10 292 | 9/1982 | Germany . |
| 2 039 666 | 8/1980 | United Kingdom . |

*Primary Examiner*—Marguerite McMahon
*Attorney, Agent, or Firm*—Smith-Hill and Bedell

[57] ABSTRACT

Piston unit for an internal combustion engine, especially for a large diesel engine, comprising at least three main parts located in successive order in the direction of the longitudinal axis of the piston and to be connected to each other. The piston unit includes a uniform upper part (3), which defines, when installed within a cylinder of the engine, a combustion chamber from the side of the piston and which is fixed inside of the piston at its central region to a middle part (2) of the piston unit preferably by means of a screw (4) or the like. At least the main part of, preferably all of the piston ring grooves (7) are arranged on a middle part (2). In addition the upper part (1) is selected to be of a material with better heat resistance than that of the middle part (2) and of a lower part (1).

13 Claims, 2 Drawing Sheets

PISTON UNIT FOR AN INTERNAL COMBUSTION ENGINE

Figure 1:
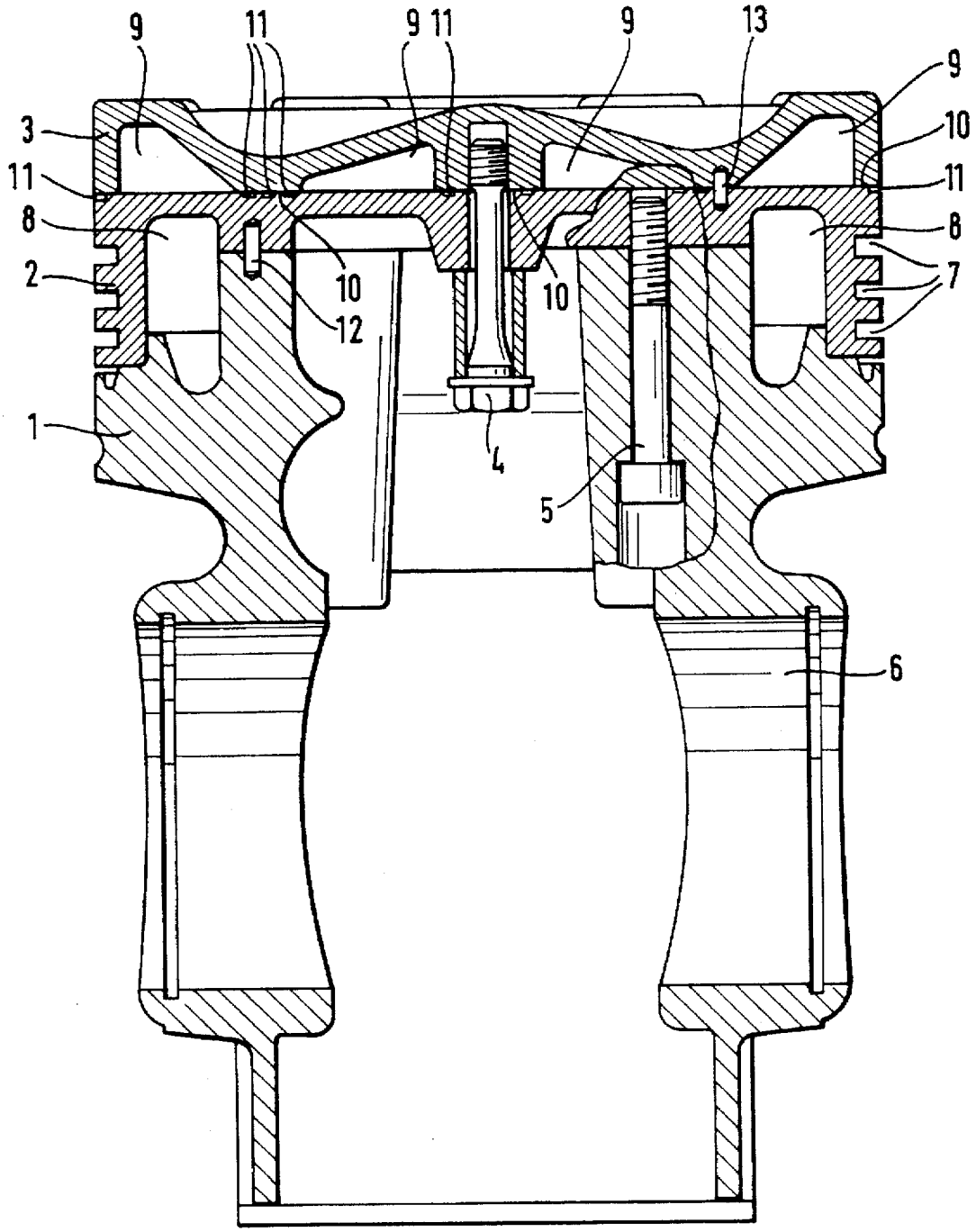

The invention relates to a piston unit for an internal combustion engine, especially for a large diesel engine, comprising at least three main parts located in successive order in the direction of the longitudinal axis of the piston and to be connected to each other.

Large diesel engines refer here to such engines that may be applied, for example, for main propulsion or auxiliary engines for ships or for power plants for production of electricity and/or heat energy.

A piston of an internal combustion engine transfers the energy released through the burning of fuel via a piston pin to a connecting rod and further to a crank mechanism. It is sealed to a cylinder of an engine by means of piston rings so that the transfer of energy would occur without essential losses. The upper part of a piston defines for its part a combustion chamber in a cylinder and is subject to substantial thermal stresses. The walls of a piston extending in the longitudinal direction of the cylinder and located below the piston rings guide the movements of the piston and serve as lubrication surfaces. In pressure charged engines the pistons are without exception also provided with passages for oil cooling.

In modern heavily loaded diesel engines so called combined or composite pistons are often used with the lower part or the piston skirt being manufactured by means of casting of spheroidal graphite iron or aluminum. Then the upper part of the piston may have been manufactured of steel by means of forging, whereby its loading properties are improved in comparison with an entirely cast piston. A composite piston is assembled by attaching a lower part and an upper part to each other through a screw joint. The number of screws can be from 1 to 6 depending on the manufacturer.

The pistons in heavy duty diesel engines are subject to high mechanical and thermal stresses. The highest allowable load capacity of a piston is indeed often a restraint for increasing the effect and/or the temperature of the burning process of an engine. The increase of the process temperature serves its purpose for instance in diesel power plants, in which the thermal energy of the exhaust gases is availed of, and in engines, in which the operation of a catalytic converter is endeavored to be improved in connection with starting and/or under partial load operation.

Quenched and tempered steel is used as material for the upper part of a piston i.a. due to manufacturing technique. The strength of quenched and tempered steels in increased temperatures is rather limited. In addition the heat expansion of the material may bring about further problems with the connection surfaces of the piston, since deformations cause changes in the distribution of tension in the contact surfaces and, thus, in the tension fields being formed. Each piston construction has an allowed field of deformation of its own, which does not permit additional increase in the temperature. It is possible to take account of the thermal expansion by increasing cold clearance in the radial direction, but this has its own limitations, because a large clearance can cause extra formation of carbon deposit in the piston crown land in connection with cold starting and wear of the cylinder in subsequent operation. Thermal expansion causes also bending of the fixing screws, decreasing, thus, the reliability of the joint. However, in constructions where the upper part is fixed to the lower part only by means of one centrally located screw, said phenomena need not be taken account of.

Increased temperature of a piston causes also the lubrication oil to burn down on the inner surfaces of the piston which results in decreased cooling effect and also in a deterioration of the quality of the lubrication oil. In addition in heavy oil operated engines a raised temperature increases the risk for hot corrosion.

A way for reducing thermal stresses in the upper part of a piston is to coat the piston on the side of the combustion chamber with some insulating coating, for example zircon oxide, but in this case the reliability of the coating has been a problem.

An aim of the invention is to accomplish a new construction for a piston unit, which provides better possibilities than before to take account of and to increase further high process temperatures to be utilized especially in diesel engines, but from which the drawbacks of the known solutions described above have essentially been eliminated. An aim of the invention is to provide a solution, which is advantageous from the viewpoint of manufacturing technique and reliable as to its construction. A further aim is to reduce heat losses occurring through the upper part of a piston.

A piston unit according to the invention includes a uniform upper part, which defines, when installed within a cylinder of the engine, a combustion chamber from the side of the piston and which is fixed inside of the piston at its central region to a middle part of the piston unit preferably by means of a screw or the like. At least the main part of, preferably all of the piston ring grooves are arranged on a middle part. In addition the material of the upper part is selected to be of a material with better heat resistance than that of the middle part and of a lower part. Thus, the invention is based on the idea of assembling a piston in a certain way of separate parts so that each part serves for the operational requirements and operation conditions of that piston part as well as possible.

Since the mass of the upper part is relatively small, the fixing thereof only at its central part is in general sufficient. Then one can avoid unfavorable deformations resulting from the use of several fixing screws. Depending on the selected materials, however, a number of auxiliary screws may be utilized, when necessary, in order to secure that the upper part keeps tightly fixed to the lower construction of the piston unit. In this case, however, a substantially smaller prestressing force is utilized for the auxiliary screws than for the fixing screw in the central region. The middle part, on the other hand, is with advantage connected to the lower part of the piston unit by means of four or more screws or the like, since the combined mass of the upper part and the middle part respectively is substantially greater.

The middle part and the lower part are provided with passages and/or bores for circulation of lubricating and/or cooling medium. Since the material of the upper part is selected to be heat resistant, it is preferably uncooled or connected only to a minor degree to the cooling system of the lower parts of the piston in order to increase the process temperature and to diminish heat losses.

In order to further diminish heat losses a connection surface between the upper part and the middle part is minimized by forming the upper part so that a number of cavities are formed between the upper part and the middle part. In addition a number of grooves are arranged on the connection surface between the upper part and the middle part.

In practice the connection surface between the upper part and the middle part can with advantage comprise contact surfaces limited in the radial direction of the piston and extending in the direction of the periphery thereof.

The proposed piston construction results in a substantial increase in the surface temperature of the piston located on the side of the combustion chamber, whereby the upper part is with advantage made of heat resistant steel. In case the temperature grows substantially higher than in conventional pistons, the upper part can be made of a heat resisting alloy material, the thermal expansion coefficient of which is relatively low (so called low expansion alloys), for example $5\times10^{-6}$ to $8\times10^{-6}$ $K^{-1}$, which is about 30–50% lower than for quenched and tempered steel. Said materials are known per se and commercially available. Materials suitable for the upper part are especially composites including typically about 20–30% nickel Depending on the material the upper part can be made by forging, casting or through powder metallurgy.

The middle part is preferably made of surface hardened steel when having in mind the durability of the piston ring grooves. The lower part can be made, in a way known as such, of spheroidal graphite cast iron or of aluminum.

Figure 2:
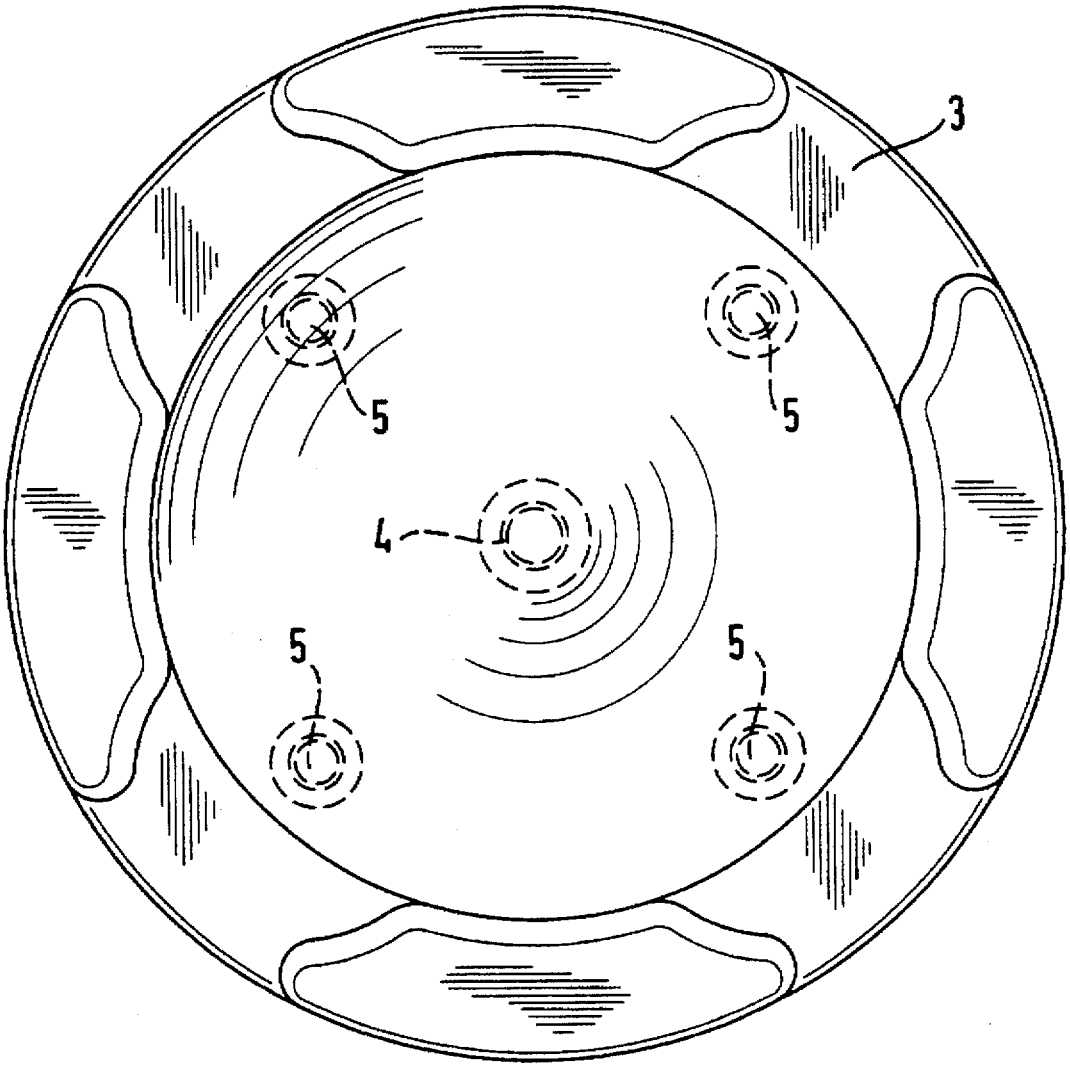

In the following the invention is described with reference to the accompanying drawings, in which FIG. 1 shows an embodiment of a piston unit according to the invention as a longitudinal section, and FIG. 2 shows the piston unit of FIG. 1 viewed from above.

A piston unit shown in the drawings includes a lower part 1, a middle part 2 and an upper part 3. The middle part 2 and the upper part 3 are fixed to each other by means of a screw bolt 4 located in the center region of the piston. The middle part 2 is fixed to the lower part 1 by means of four screw bolts 5. A construction of this kind provides possibilities to select the material for each part independent of each other to conform to the operation and conditions of each part in a way serving its purpose as well as possible. From the viewpoint of keeping the upper part 3 tightly pressed to the lower construction of the piston unit, when necessary, some auxiliary screws located more close to the periphery of the piston may be utilized. The prestressing force of these auxiliary screws, however, is essentially smaller than that of the screw bolt 4.

The lower part 1 includes a connecting rod boss 6. In addition the lower part 1 and the middle part 2 define together a passage 8 being part of a cooling system. The cooling system can include, when necessary, a number of passages and bores located in a known way in the lower part 1 and/or in the middle part 2 and which have not been shown here for clarity. The lower part can with advantage be of spheroidal graphite cast iron or aluminum.

The middle part is provided with piston ring grooves 7, due to which it is preferably of surface hardened steel. When being installed within a cylinder of an engine (not shown) the upper part 3 of the piston unit is through its upper surface limited to and, hence, defines from the side of the piston a combustion chamber of the cylinder, due to which it is with advantage made of heat resistant steel material or the like. The upper part 3 is provided with cavities 9, which limit the area of contact surfaces 10 between the upper part 3 and the middle part 2 to the minimum for decreasing heat losses. This, for its part, makes it possible to increase the process temperature in the combustion chamber of a cylinder and, thus, improves the efficiency ratio of the burning process of an engine and possible recovery of heat energy from the exhaust gases of an engine. The effect is increased by grooves 11, which decrease further the direct contact surface. The reference numerals 12 and 13 indicate guiding pins, which guide the separate parts to correct position relative to each other.

The invention is not limited to the embodiment shown, but several modifications are feasible within the scope of the attached claims.

We claim:

1. A piston unit for an internal combustion engine, especially for a large diesel engine, said piston unit having a longitudinal axis and comprising:

an upper part that bounds a combustion chamber of the engine when the piston unit is fitted in a cylinder of the engine, the upper part being uniform and having a central region, a middle part that is formed with grooves for receiving piston rings, a fastening means extending along a central axis of the piston unit and holding the upper part of the piston unit in contact with the middle part thereof by engagement with the central region of the upper part, said fastening means including a bolt having a threaded portion in engagement with the upper part of the piston unit a shank passing through an aperture in the middle part, and a head spaced from the middle part and the fastening means further including a sleeve in force transmitting relationship between the head of the bolt and the middle part of the piston unit, and a lower part attached to the middle part, and wherein the upper part is of better heat resistance than either the middle part or the lower part.

2. A piston unit according to claim 1, comprising at least four fastening elements attaching the middle part of the piston to the lower part thereof.

3. A piston unit according to claim 1, wherein the middle part and the lower part are formed with passages and/or bores for circulation of a lubricating and/or cooling medium.

4. A piston unit according to claim 1, wherein the upper part has a lower surface formed with recesses having interior surfaces spaced from the middle part.

5. A piston unit according to claim 4, wherein the middle part has surface regions that are in contact with surface regions of the upper part, and at least one of said surface regions is formed with grooves.

6. A piston unit according to claim 1, wherein the upper part has surface regions that are in contact with surface regions of the middle part, and at least one of said surface regions is formed with grooves.

7. A piston unit according to claim 1, wherein the upper part and the middle part are in contact over an annular surface region that is substantially coaxial with the piston unit, and the upper part and the middle part are spaced apart radially inward of the contact surface.

8. A piston unit according to claim 7, wherein said annular surface region is at the periphery of the piston unit.

9. A piston unit according to claim 1, wherein the upper part is made of heat resistant steel.

10. A piston unit according to claim 1, wherein the upper part is made of a heat resistant alloy material of relatively low thermal expansion coefficient.

11. A piston unit according to claim 10, wherein the thermal expansion coefficient of the heat resistant alloy material is in the range from about $5\times10^{-6}$ $K^{-1}$ to about $8\times10^{-6}$ $K^{-1}$.

12. A piston unit according to claim 1, wherein the middle part is made of surface hardened steel.

13. A piston unit according to claim 1, wherein the lower part is made of spheroidal graphite cast iron or aluminum.

* * * * *